US010752015B2

(12) United States Patent
Villavelez et al.

(10) Patent No.: US 10,752,015 B2
(45) Date of Patent: Aug. 25, 2020

(54) DISSIPATING HEAT OF HEATING ELEMENTS

(71) Applicant: HEWLETT-PACKARD DEVELOPMENT COMPANY, L.P., Spring, TX (US)

(72) Inventors: Reynaldo V Villavelez, Corvallis, OR (US); Terry McMahon, Corvallis, OR (US); Donald W Schulte, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/323,219

(22) PCT Filed: Oct. 20, 2016

(86) PCT No.: PCT/US2016/057824
§ 371 (c)(1),
(2) Date: Feb. 4, 2019

(87) PCT Pub. No.: WO2018/075039
PCT Pub. Date: Apr. 26, 2018

(65) Prior Publication Data
US 2019/0248157 A1 Aug. 15, 2019

(51) Int. Cl.
*B41J 2/345* (2006.01)
*B41J 2/335* (2006.01)

(52) U.S. Cl.
CPC ..... *B41J 2/345* (2013.01); *B41J 2/3358* (2013.01)

(58) Field of Classification Search
CPC . B41J 2/345; B41J 2/3358; B41J 2/335; B41J 2/33505; B41J 2/3352; B41J 2/34
See application file for complete search history.

(56) References Cited

U.S. PATENT DOCUMENTS

| | | | |
|---|---|---|---|
| 5,028,934 | A | 7/1991 | Kasai et al. |
| 5,680,170 | A | 10/1997 | Taniguchi et al. |
| 8,057,004 | B2 | 11/2011 | Silverbrook et al. |
| 8,154,574 | B2 | 4/2012 | Neuhard et al. |
| 8,411,121 | B2 | 4/2013 | Yamamoto |
| 9,352,585 | B2 | 4/2016 | Hoki et al. |
| 2009/0267992 | A1 | 10/2009 | Silverbrook et al. |

(Continued)

FOREIGN PATENT DOCUMENTS

| | | |
|---|---|---|
| CN | 1128972 | 8/1996 |
| CN | 1371318 | 9/2002 |

(Continued)

OTHER PUBLICATIONS

Kyocera Develops World's Smallest Thermal Printhead for Barcode Printing, Jul. 28, 2016, < http://www.kyocera.co.uk/index/news/news_detail.L3RoZXJtYWxfcHJpbnRoZWFkcy9uZXdzLzlwMTYvS1IPQ0VSQV9EZXZIbG9wc19Xb3JsZF9zX1NtYWxsZXN0X1RoZXJtYWxfUHJpbnRoZWFkX2Zvcl9CYXJjb2RIX1ByaW50aW5n.html >.

*Primary Examiner* — Kristal Feggins
(74) *Attorney, Agent, or Firm* — Trop, Pruner & Hu, P.C.

(57) ABSTRACT

In some examples, a heater assembly for a pattern forming system includes a support, and heating elements mounted on the support, where the heating elements are to, in response to activation of the heating element, produce heat directed towards a target to form a pattern on the target. A heat sink is thermally connected to the heating elements and comprising a pattern of heat dissipation surfaces comprising channels to dissipate heat produced by the heating elements.

20 Claims, 7 Drawing Sheets

(56) References Cited

U.S. PATENT DOCUMENTS

| | | | |
|---|---|---|---|
| 2010/0103238 | A1 | 4/2010 | Neuhard et al. |
| 2012/0320139 | A1 | 12/2012 | Yamamoto |
| 2014/0111595 | A1 | 4/2014 | Vetterling et al. |

FOREIGN PATENT DOCUMENTS

| | | |
|---|---|---|
| CN | 102596544 | 7/2012 |
| CN | 102933395 | 2/2013 |
| EP | 1352733 | 10/2003 |
| EP | 2578409 | 4/2013 |
| SU | 1275792 | 7/1986 |
| WO | WO-2011045291 | 4/2011 |
| WO | WO-2014034659 | 3/2014 |

DISSIPATING HEAT OF HEATING ELEMENTS

BACKGROUND

Thermal printers can form print images by heating a print medium that is sensitive to heat. In some examples, such print medium (referred to as a "thermal print medium") can be coated with a thermally sensitive coating. The thermally sensitive coating can change color (e.g., turn from white to black, or change between other combinations of colors) in portions of the thermally sensitive coating that are heated. The portions that change color form a target image on the print medium. The heating can be performed using heating elements arranged on a thermal head of a thermal printer.

BRIEF DESCRIPTION OF THE DRAWINGS

Some implementations of the present disclosure are described with respect to the following figures.

DETAILED DESCRIPTION

In the present disclosure, the article "a," "an", or "the" can be used to refer to a singular element, or alternatively to multiple elements unless the context clearly indicates otherwise. Also, the term "includes," "including," "comprises," "comprising," "have," or "having" is open ended and specifies the presence of the stated element(s), but does not preclude the presence or addition of other elements.

During a print operation of a thermal printer, heating elements of a heater of the thermal printer are activated to generate heat directed to a print medium. Portions of the print medium that are heated can change color to form a target image on the print medium.

Thermal printers can suffer from deteriorated image quality and battery life as a result of elevated temperatures resulting from print operations, particularly print operations where a larger number of pages are being printed one after another in a relatively short time span. Heating elements, such as heating resistors, can become overheated, which can reduce the switching speed (switching between on and off) of such heating elements. Also, at an elevated temperature, a battery in a thermal printer can lose charge more rapidly, and thus battery life can suffer if the thermal printer operates at too high a temperature.

Although reference is made to heat dissipation techniques or mechanisms for use with thermal printers in some examples of the present disclosure, it is noted that in further examples, heat dissipation techniques or mechanisms can be applied to other systems that use heat to form patterns on targets, where targets can include a planar structure, a three-dimensional object, and so forth.

In accordance with some implementations of the present disclosure, heat dissipation mechanisms are provided for increased heat dissipation in pattern forming systems (such as thermal printers or other systems that are able to use heat to form patterns on targets), to dissipate heat produced by heating elements of the pattern forming systems. A heat dissipation mechanism according to some implementations can include a heat sink thermally connected to heating elements and including a pattern of heat dissipation surfaces comprising channels to dissipate heat produced by the heating elements. A first component is "thermally connected" to a second component when the first component and second component are in direct contact with one another, or alternatively, when a thermally conductive layer (or multiple thermally conductive layers) are provided between the first and second components to provide heat transfer between the first and second components.

In further or alternative examples, an electrically conductive layer that is electrically connected to the heating elements can be formed with channels, such as openings, to provide heat dissipation surfaces to dissipate heat produced by the heating elements.

Figure 1A:
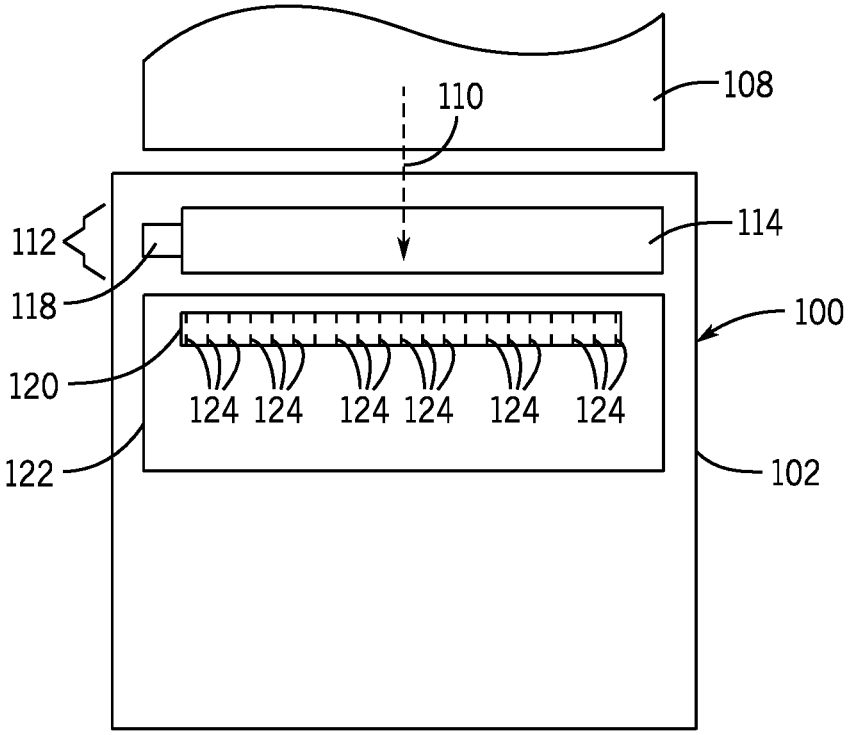
FIGS. 1A and 1B are top and side views, respectively, of a thermal printer according to some examples.
Figure 1B:
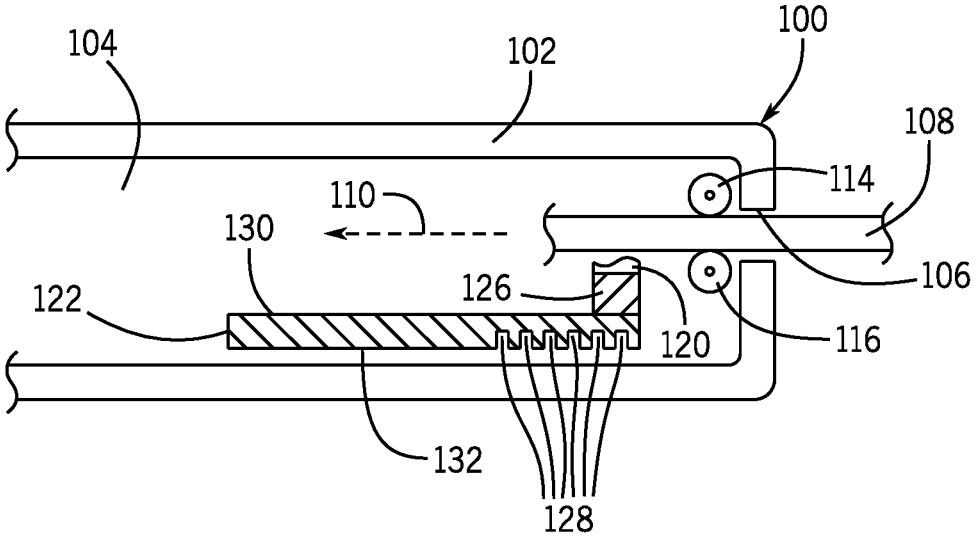

FIGS. 1A and 1B depict a thermal printer 100. FIG. 1A is a top view of a portion of the thermal printer 100, while FIG. 1B is a sectional side view of a portion of the thermal printer 100. The thermal printer includes an outer housing 102 that defines an inner chamber 104 in which components of the thermal printer 102 are located. The outer housing 102 can be formed of a single housing structure, or as multiple housing structures attached together. The housing 102 has a print medium feed receptacle 106 through which a print medium 108, such as a paper substrate or another type of substrate, can be passed to perform printing of an image onto the print medium 108. As shown in FIGS. 1A and 1B, the print medium 108 is passed through the printer 100 along a print direction 110 during a print operation.

The thermal printer 100 includes a feeder 112, which includes rollers 114 and 116 in some examples, to pass the print medium 108 through a passageway of the thermal printer 100. Each roller 114 or 116 is a rotatable structure. The rollers 114 and 116 define a gap between the rollers 114 and 116 through which the print medium 108 is able to pass during a print operation. The rollers 114 and 116 engage respective opposite surfaces of the print medium 108 when the print medium 108 is inserted into the gap between the rollers 114 and 116. Rotation of the rollers 114 and 116 cause movement of the print medium 108 along the print direction 110. The feeder 112 also includes a motor 118 that when activated causes rotation of the roller 114. In other examples, the motor 118 can be operatively connected to the roller 116 to rotate the roller 116 when the motor 118 is activated.

More generally, the feeder 112 includes components that when actuated cause movement of the print medium 108 along the print direction 110. In other examples, a different arrangement of rollers can be provided in the feeder 112. In further examples, instead of using the motor 118, a different actuator can be used for rotating the rollers 114 and 116. In yet further examples, instead of using rollers, the feeder 112 can use different moveable components for moving the print medium 108 in the print direction 110. For example, the moveable components can include sliders. In yet further examples, movement of the print medium 108 by the feeder 112 can be based on use of forced airflow that directs the print medium 108 along the print direction 110.

The thermal printer includes a heater 120 which is thermally connected to a backing plate 122. The backing plate 122 can refer to any type of support structure that can be used for supporting the heater 120 as well as other components (not shown). As discussed further below, such other components can include a circuit board.

The backing plate 122 can be formed of a metal, a compound that includes a metal and another material, or of any other thermally conductive material. The heater 120 includes an array of heating elements 124 that extend along a width of the heater 120, where the width of the heater 120 extends along a direction that is generally perpendicular to the print direction 110. The heating elements 124 extend along a width of the print medium 108. Selected heating elements 124 can be activated to cause formation of an image on the print medium 108 as the print medium 108 is advanced across the heater 120 in the print direction 110 during a print operation. The print medium 108 can be coated with a thermally sensitive coating, which can change color (e.g., turn from white to black, or change between other combinations of colors) in portions of the thermally sensitive coating that are heated by the selected heating elements 124.

As the print medium 108 advances along the print direction 110, selected heating elements 124 of the heater 120 are activated for each row of the print medium 108, to form a respective portion of a target image on the print medium 108. Although not shown, a platen can also be provided in the inner chamber 104 of the thermal printer 100 to support the print medium 108 as the print medium 108 passes through the thermal printer 100.

In some examples, each heating element 124 is implemented as a resistor that heats up in response to an electrical current passed through the resistor. Although not shown in FIGS. 1A and 1B, drivers can be used to drive signals to the heating elements 124, where the drivers are selectively activated to control which of the heating elements 124 are activated to perform heating.

As further shown in FIG. 1B, the heater 120 is thermally connected to the backing plate 122 through a heat block 126, or other thermally conductive layer that can be provided between the heater 120 and the backing plate 122. The heat block 126 is mounted on a first surface 130 (upper surface in the orientation shown in FIG. 1B) of the backing plate 122, and acts as a support for the heater 120. The heat block 126 is thermally contacted to the backing plate 122. The heat block 126 is formed of a thermally conductive material, such as a metal, a compound that includes a metal and another material, or a non-metallic thermally conductive material. In further examples, the heater 120 can be directly thermally contacted to the backing plate 122.

A portion of the backing plate 122 is formed with channels 128, which can include slots cut into a second surface 132 (a lower surface in the orientation shown in FIG. 1B) of the backing plate 122. Heat fins are provided between the channels 128 on the backing plate 122. The channels 128 formed in the backing plate 122 define heat a pattern of dissipation surfaces (between the heat fins) to dissipate heat that is transferred to the backing plate 122 by the heating elements 124 of the heater 120. By forming the channels 128 in the backing plate 122, a larger heat dissipation surface area is provided as compared to implementations of the backing plate 122 where the channels 128 are not formed.

Airflow can also pass through the channels 128 to carry heat away from the heat dissipation surfaces defined by the channels 128. Effectively, the backing plate 122 (or a portion of the backing plate 122) is a heat sink that serves to dissipate heat produced by the heating elements 124 of the heater 120 during a print operation.

Figure 2:
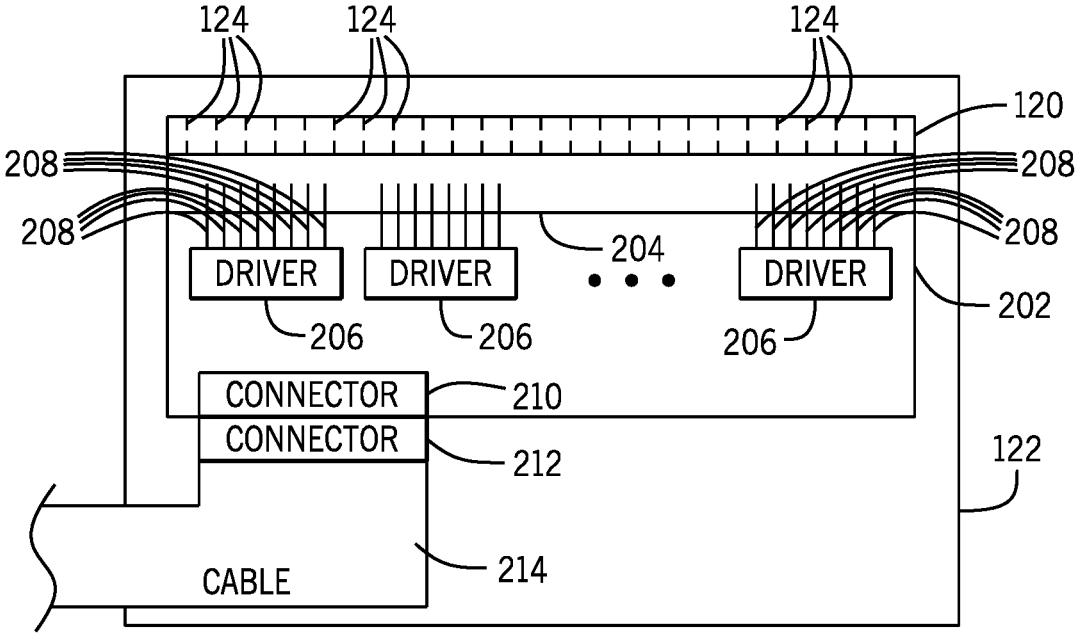
FIG. 2 is a block diagram of an assembly that includes a heater, a circuit board, a cable, and a backing plate, according to some examples.

FIG. 2 illustrates an assembly that includes the backing plate 122 (an example of a heat sink), the heater 120, and a circuit board 202. Although a specific arrangement of components is shown in FIG. 2, it is noted that in other examples, other arrangements of components can be used. The circuit board 202 has a number of drivers 206 that are controllable to activate the respective heating elements 124 of the heater 120. Although multiple drivers are shown in FIG. 2, it is noted that in other examples, just one driver can be provided. Each driver 206 has output pins that are electrically connected by electrically conductive wires 208 to electrically conductive traces of a connector portion 204 of the heater 120. The electrically conductive traces of the connector portion 204 are electrically connected to corresponding heating elements 124.

To activate a respective heating element 124, a driver 206 outputs an electrical signal over a respective wire 208, which provides an electrical current that is passed through the respective heating element 124 to cause heating of the heating element 124.

The circuit board 202 has a connector 210 that can be connected to a mating connector 212 of a cable 214. The cable 214 can be a flex cable or other type of cable. The cable 214 carries power and signals that are communicated through the connectors 212 and 210 to electrically conductive traces of the circuit board 202. The power and signals are provided to the respective drivers 206. The thermal printer 100 can include a controller (not shown) that is connected to the cable 214. The controller can control print operations of the thermal printer 100, based on image data received by the controller. In response to the image data, the controller can decide which of the heating elements 124 are to be activated for a given row along the width of the print medium 108.

Figure 3A:
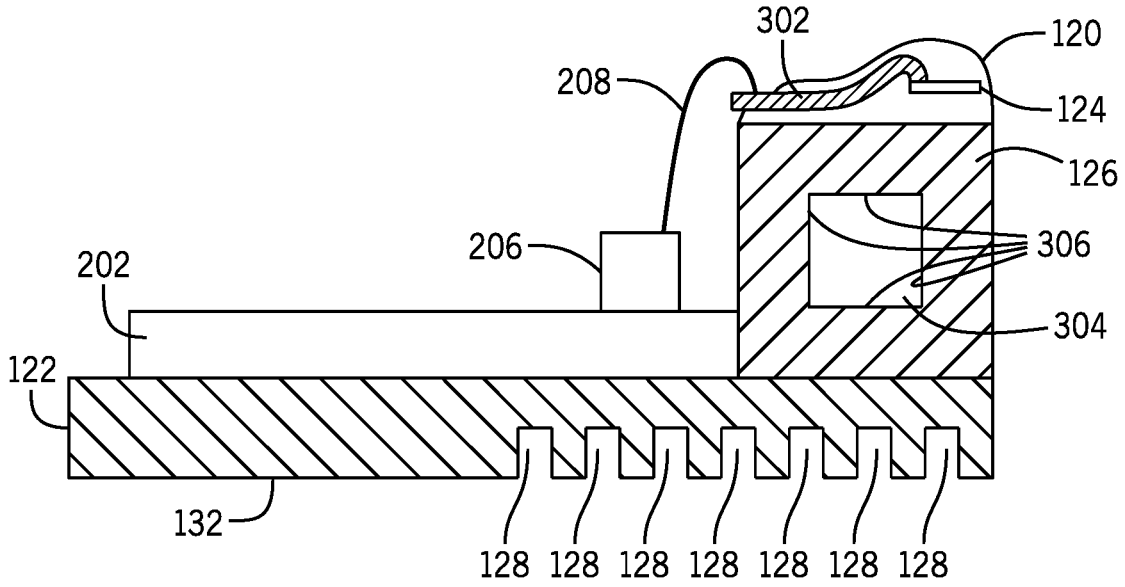
FIGS. 3A-3C are sectional side views of respective assemblies each including a heater, a circuit board, a heat block, and a backing plate, according to further examples.

FIG. 3A is a sectional side view of an assembly that includes the backing plate 122, the circuit board 202, the heat block 126, and the heater 120, according to some examples. As shown in FIG. 3A, a wire 208 connects the driver 206 to an electrically conductive layer 302 of the heater 120. The electrically conductive layer 302 extends to make electrical contact with a first node of the heating element 124 (e.g., a resistor formed with a layer of material that has a specified resistance). A second node of the heating element 124 is electrically connected to another electrically conductive layer (not shown in FIG. 3A). An electrical current output from the driver 206 passes over the wire 208 and through the electrically conductive layer 302 to the heating element 124. The electrical current passes from the first node of the heating element 124 to the second node of the heating element 124, to cause heating of the heating element.

As further shown in FIG. 3A, an opening 304 is formed through the heat block 126. The opening 304, formed generally in the center of the heat block 126, defines heat dissipation surfaces 306 to allow for additional heat dissipation. Airflow can pass through the opening 304 to carry heat away from the heat dissipation surfaces 306.

FIG. 3A shows channels 128 formed in a portion of the backing plate 122. The portion of the backing plate 122 in which the channels 128 are formed are generally underneath the heater 120, in the orientation shown in FIG. 3A.

Figure 3B:
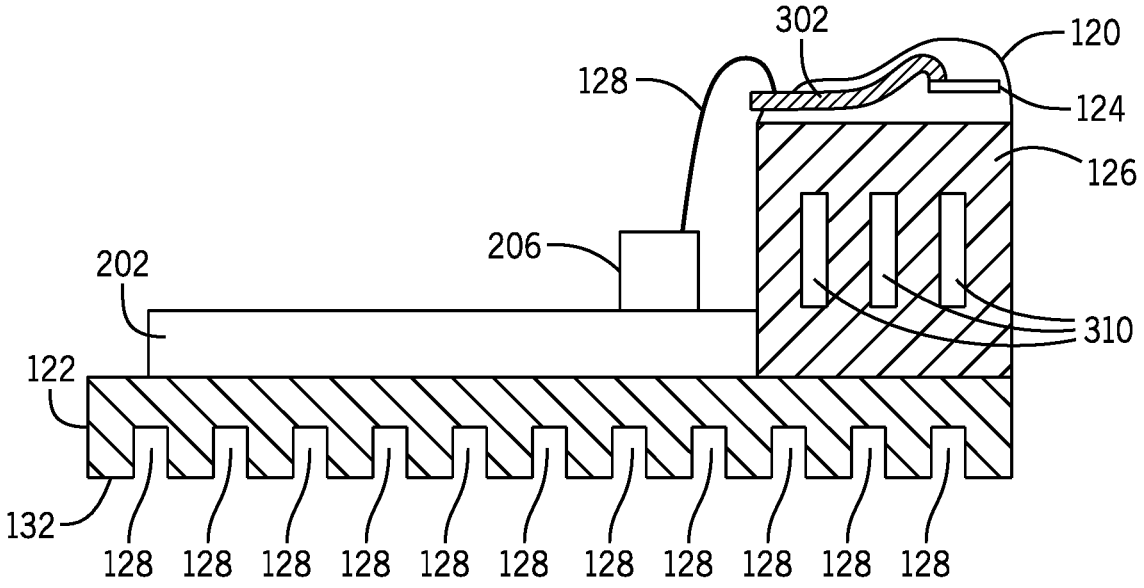

FIG. 3B shows a sectional side view of an assembly that is similar to the assembly of FIG. 3A, except that in FIG. 3B, more channels 128 are formed in the second surface 132 of the backing plate 122, to define more heat dissipation surfaces in the backing plate 122 of FIG. 3B than in the backing plate 122 of FIG. 3A. In addition, in FIG. 3B, multiple openings 310 are formed in the heat block 126, instead of the single larger opening 304 formed in the heat block 126 of FIG. 3A. The multiple openings 310 provide channels that define heat dissipation surfaces and provide airflow paths.

Figure 3C:
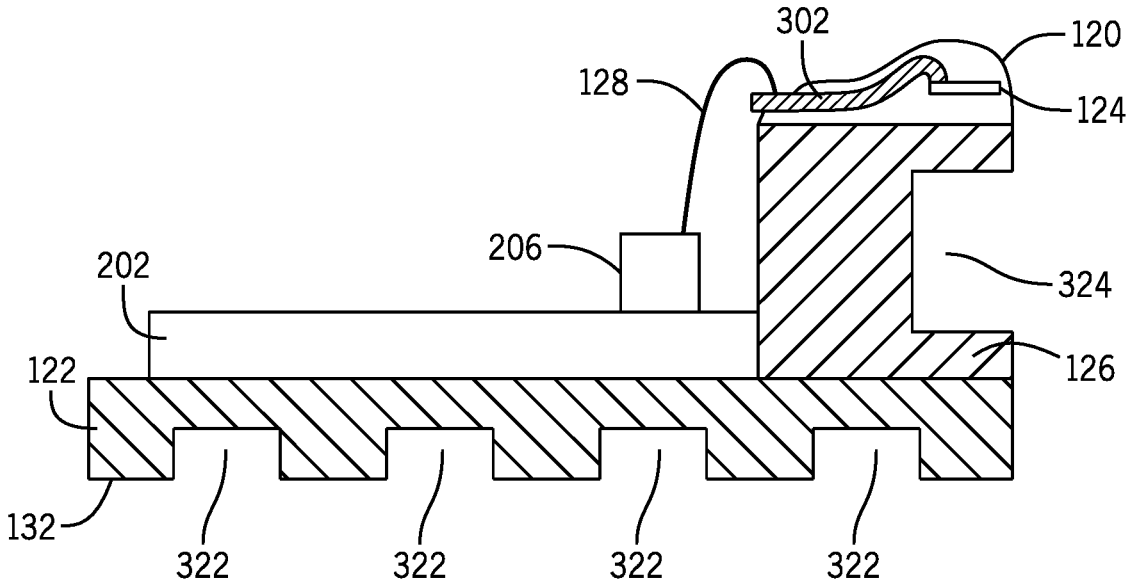

FIG. 3C shows another example arrangement of an assembly that is similar to the assembly of FIG. 3A. In FIG. 3C, larger channels 322 are formed in the second surface 132 of the backing plate 122 (a channels 322 has a greater width than a channel 128 shown in FIG. 3A or 3B). In addition, an opening 324 is formed in a side of the heat block 126, rather than in the center region of the heat block 126 as in FIG. 3A.

Figure 4:
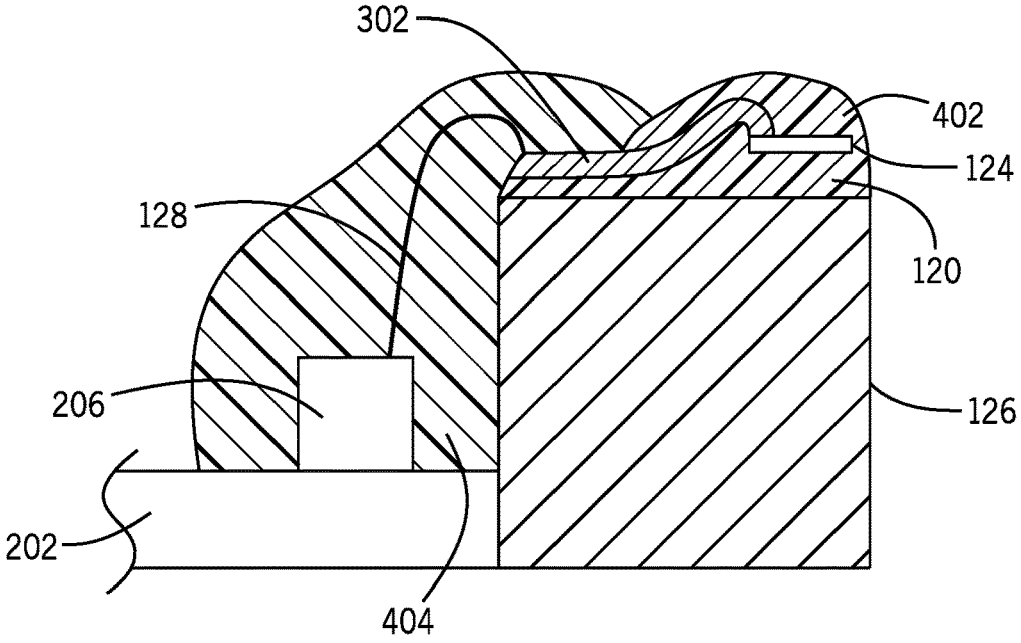
FIG. 4 is a sectional side view of a portion of an assembly that includes a heater, a circuit board, and a heat block, according to further examples.

FIG. 4 shows a portion of an assembly that includes the circuit board 202, the heat block 126, and the heater 120, according to further examples. As shown in FIG. 4, an insulating layer 402 is provided over a portion of the heater 120, and another insulating layer 404 is provided over a portion of the heater 120 and the driver 206. The insulating layers 402 and 404 (which can also be referred to as passivation layers) are provided to protect the components of the heater 120 and the circuit board 122. Although two insulating layers 402 and 404 are shown, it is noted that in other examples, just one insulating layer can be used, or more than two insulating layers can be used.

In some examples, the insulating layer 402 can be doped with a material to increase a thermal conductivity of the insulating layer 402. Doping the insulating layer 402 with a material can refer to adding a foreign material to the insulating layer 402. For example, the insulating layer 402 can be formed of silicon nitride, and can be doped with yttrium to increase the thermal conductivity of the insulating layer 402. In other examples, the insulating layer 402 can be formed of a different insulating material, and can be doped with yttrium or other materials to increase thermal conductivity. More generally, an insulating layer that is doped with a material to enhance its thermal conductivity is referred to as a thermally conductive insulating layer. The insulating layer 402 conducts heat from the heating element 124, and is directed towards a print medium or other target. The insulating layer 402 can extend over a large portion of the heater 120, and can extend over multiple heating elements 124.

Figure 5A:
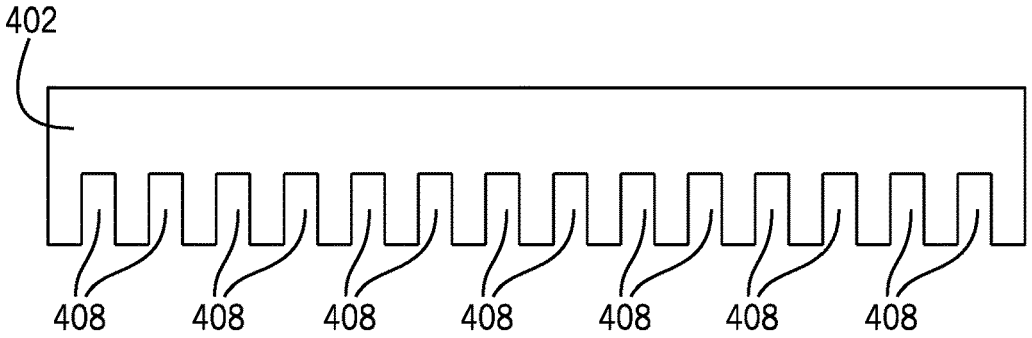
FIGS. 5A and 5B are top views of an electrically conductive layer that is part of the assembly of FIG. 4, according to alternative examples.

A top view of the thermally conductive doped insulating layer 402 according to some examples is shown in FIG. 5A. Channels 408 are formed in the thermally conductive doped insulating layer 402, which causes formation of heat fins in the thermally conductive doped insulating layer 402. The channels 408 are formed with slots cut into an edge of the thermally conductive doped insulating layer 402. The channels 408 effectively increase the heat dissipation surface area of the thermally conductive doped insulating layer 402 to dissipate heat from the heating elements 124 of the heater 120.

Figure 5B:
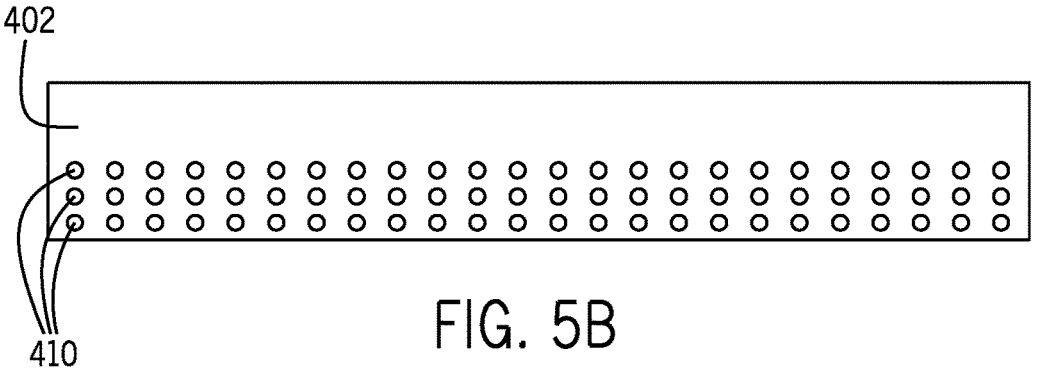

FIG. 5B shows a top view of the thermally conductive doped insulating layer 402 according to alternative examples. In FIG. 5B, instead of channels 408 cut into an edge of the thermally conductive doped insulating layer 402, the channels of FIG. 5B include an array of openings 410 formed in the thermally conductive doped insulating layer 402. The array of openings 410 provide increased heat dissipation surfaces for dissipating heat from the heating elements 124 of the heater 120.

In further examples, the thermally conductive doped insulating layer 402 can include other structures, such as a combination of the channels 408 and the openings 410, to provide increased heat dissipation surfaces.

Figure 6:
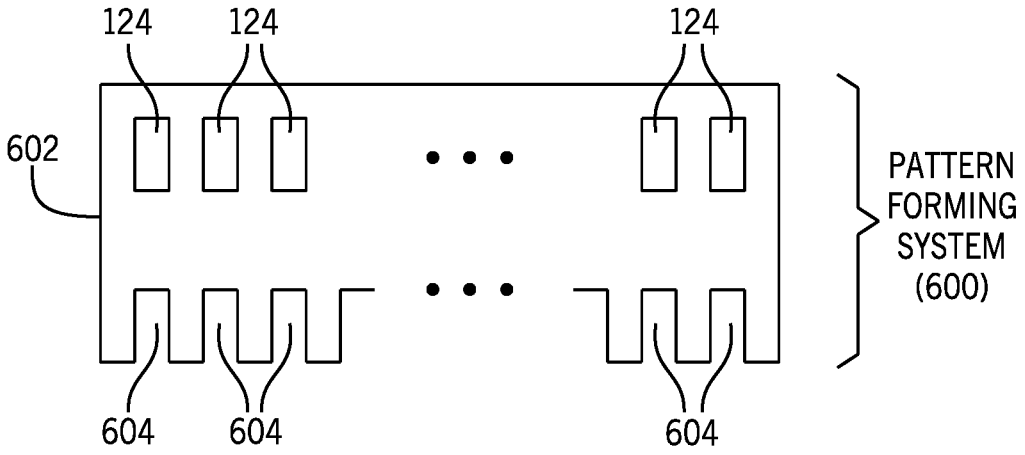
FIG. 6 is a block diagram of a portion of an image forming system according to some examples.

FIG. 6 shows a portion of a pattern forming system 600. The pattern forming system 600 includes heating elements 124 that are to produce heat to form a pattern on a target. A thermally conductive doped insulating layer 602 (or another type of thermally conductive layer), which is similar to the thermally conductive doped insulating layer 402 of FIGS. 4 and 5A-5B, is provided over the heating elements 124. The thermally conductive doped insulating layer 602 is "provided over" the heating elements 124 if the insulating layer 602 covers or otherwise is in thermal contact with and disposed between the heating elements 124 and another object. The thermally conductive doped insulating layer 402 is to conduct heat from the heating elements 124 towards a print medium or other target. The thermally conductive doped insulating layer 602 includes channels 604 formed in the thermally conductive doped insulating layer 602, where the channels 604 provide heat dissipation surfaces to dissipate heat generated by the heating elements 124.

Figure 7:
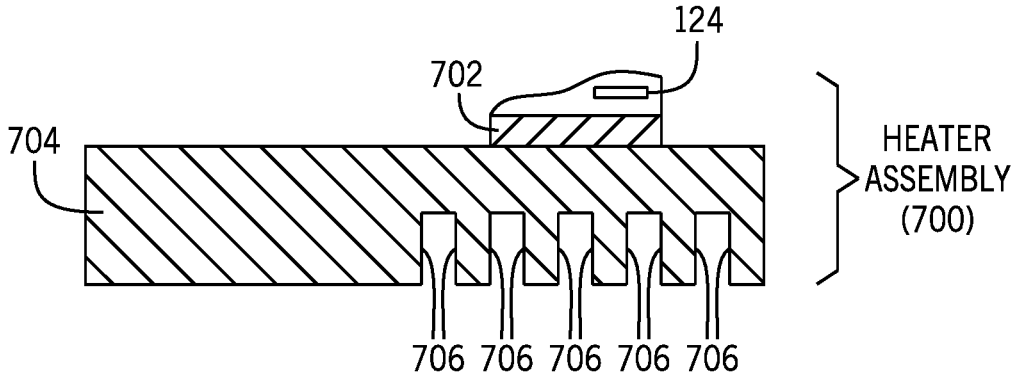
FIG. 7 is a block diagram of a heater assembly according to some examples.

FIG. 7 illustrates a heater assembly 700 that can be used in a pattern forming system. The heater assembly 700 includes heating elements 124 that are mounted on a support 702, which can be implemented as a heat block, such as the heat block 126 shown in FIGS. 1B, 3A-3C, and 4. In other examples, the support 702 can include a thinner thermally conductive layer between the heater 120 and the heat sink 704. In yet further examples, the support can be integrally formed with the heater 120, and is used to support the heating elements 124; in such latter examples, the heat block 126 shown in FIGS. 1B, 3A-3C, and 4 can be omitted, and the heater 120 is directly mounted on the heat sink 704.

The support 702 is arranged on a heat sink 704, which can be implemented as the backing plate 122 of FIGS. 1A-1B, 3A-3C. The heat sink 704 has a pattern of heat dissipation surfaces 706 that make up channels to dissipate heat produced by the heating elements 124.

Figure 8:
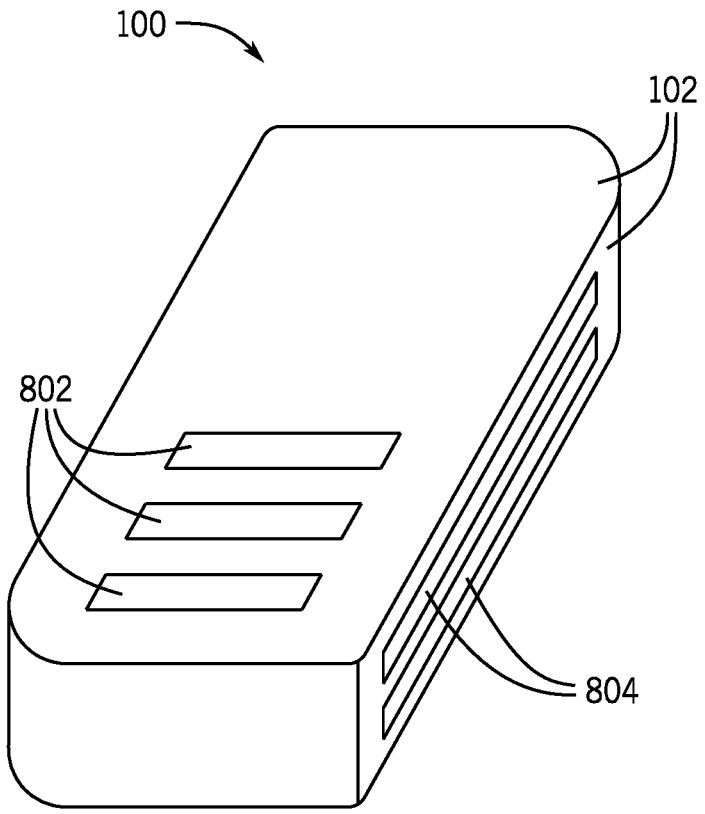
FIG. 8 is a perspective side view of a thermal printer according to further examples.

FIG. 8 is a perspective side view of a thermal printer 100 according to some examples. The housing 102 of the thermal printer 100 is formed with perforations 802 and 804. The perforations 802 are formed in an upper part of the housing 102, while the perforations 804 are formed in a side part of the housing 102. In further examples, only the perforations 802 are provided, without the perforations 804, or vice versa. Airflow can pass from inside the thermal printer 100 through the perforations 802 and/or 804 to outside the thermal printer 100, to carry heat away from the inside of the thermal printer 100.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A heater assembly for a pattern forming system, comprising:

a support;

heating elements mounted on the support, the heating elements to, in response to activation of the heating elements, produce heat directed towards a target to form a pattern on the target; and a heat sink thermally connected to the heating elements and comprising a pattern of heat dissipation surfaces comprising channels to dissipate heat produced by the heating elements, wherein the support comprises a thermally conductive block thermally contacted to the heat sink.

2. The heater assembly of claim 1, wherein the pattern of heat dissipation surfaces are provided by heat fins formed between the channels.

3. The heater assembly of claim 1, wherein an opening is formed in the thermally conductive block to provide further heat dissipation surfaces on the thermally conductive block.

4. The heater assembly of claim 3, wherein the opening is in a center region of the thermally conductive block.

5. The heater assembly of claim 3, wherein the opening is in a side of the thermally conductive block.

6. A heater assembly for a pattern forming system, comprising:

a support;

heating elements mounted on the support, the heating elements to, in response to activation of the heating elements, produce heat directed towards a target to form a pattern on the target;

a heat sink thermally connected to the heating elements and comprising a pattern of heat dissipation surfaces comprising channels to dissipate heat produced by the heating elements; and a thermally conductive doped insulating layer provided over the heating elements.

7. The heater assembly of claim 6, wherein the heating elements comprise heating resistors.

8. The heater assembly of claim 6, wherein channels are formed in the thermally conductive doped insulating layer to provide heat dissipation surfaces.

9. The heater assembly of claim 8, wherein the channels comprise an array of openings in the thermally conductive doped insulating layer.

10. The heater assembly of claim 6, wherein the thermally conductive doped insulating layer is doped with yttrium.

11. The heater assembly of claim 6, wherein the thermally conductive doped insulating layer is formed of silicon nitride.

12. A pattern forming system comprising:

heating elements to produce heat to form a pattern on a target;

a thermally conductive layer provided over the heating elements, the thermally conductive layer comprising a plurality of channels that provide heat dissipation surfaces to dissipate heat generated by the heating elements; and an outer cover comprising a perforation through which airflow is to be passed between an inner chamber of the pattern forming system and an outside of the pattern forming system for heat dissipation.

13. The pattern forming system of claim 12, further comprising:

a thermally conductive block supporting the heating elements; and a heat sink thermally contacted to the thermally conductive block and comprising a pattern of heat dissipation surfaces defined by channels to dissipate heat produced by the heating elements.

14. The pattern forming system of claim 13, further comprising:

a circuit board, wherein the heat sink supports the circuit board.

15. The pattern forming system of claim 13, wherein an opening is formed through the thermally conductive block to provide heat dissipation surfaces in the thermally conductive block.

16. The pattern forming system of claim 12, wherein the thermally conductive layer is doped with yttrium.

17. The pattern forming system of claim 12, wherein the thermally conductive layer is formed of silicon nitride.

18. A thermal printer comprising:

a feeder to pass a print medium through a passageway of the thermal printer;

a backing plate; and a heater thermally connected to the backing plate, the heater comprising heating elements to produce heat to form an image on a print medium, wherein the backing plate comprises a plurality of channels to define heat dissipation surfaces to dissipate heat from the heating elements; and a circuit board mounted on the backing plate, the circuit board comprising a driver to activate a heating element of the heating elements.

19. The thermal printer of claim 18, further comprising a thermally conductive block supporting the heating elements, the thermally conductive block thermally contacted to the backing plate.

20. The thermal printer of claim 19, wherein the thermally conductive block comprises an opening to provide further heat dissipation surfaces on the thermally conductive block.

* * * * *